US007954177B2

(12) United States Patent
Ide et al.

(10) Patent No.: US 7,954,177 B2
(45) **Date of Patent: *Jun. 7, 2011**

(54) SPORTS HELMET

(75) Inventors: Thad M. Ide, Chicago, IL (US); Ralph J. Infusino, Bloomingdale, IL (US); Nelson Kraemer, Mt. Prospect, IL (US); Christopher R. P. Withnall, Nepean (CA); Timothy D. Bayne, Nepean (CA)

(73) Assignee: Riddell, Inc., Rosemont, IL (US)

( * ) Notice: Subject to any disclaimer, the term of this patent is extended or adjusted under 35 U.S.C. 154(b) by 101 days.

This patent is subject to a terminal disclaimer.

(21) Appl. No.: 11/653,078

(22) Filed: Jan. 10, 2007

(65) Prior Publication Data

US 2007/0192944 A1 Aug. 23, 2007

Related U.S. Application Data

(60) Division of application No. 11/208,233, filed on Aug. 18, 2005, now Pat. No. 7,240,376, which is a continuation of application No. 10/427,236, filed on May 1, 2003, now Pat. No. 6,934,971.

(60) Provisional application No. 60/376,898, filed on May 1, 2002.

(51) Int. Cl.
*A63B 71/10* (2006.01)

(52) U.S. Cl. ..... 2/425

(58) Field of Classification Search ..... 2/410, 424, 2/423, 425, 411, 412, 413, 9

See application file for complete search history.

(56) References Cited

U.S. PATENT DOCUMENTS 1,060,220 A 4/1913 White
1,203,564 A 11/1916 April (Continued)

FOREIGN PATENT DOCUMENTS

CH 692011 1/2002

(Continued)

OTHER PUBLICATIONS

Expert Report of Mr. Rovani filed Dec. 15, 2009, *Riddell, Inc.* v. *Schutt Sports, Inc.*; U.S. District Court for the W.D. of Wisconsin; 08-cv-711.

(Continued)

*Primary Examiner* — Danny Worrell

(74) *Attorney, Agent, or Firm* — McDermott Will & Emery LLP

(57) ABSTRACT

The present invention provides a sports helmet, such as a football, hockey, lacrosse or baseball helmet. The helmet includes a shell having an outer surface, a front region, a rear region, and two side regions. A jaw flap extends from each ear flap towards the front region of the shell, wherein the jaw flap overlies an extent of a mandible of a wearer of the helmet. A crown, defined by a raised band of the shell, extends between the front and rear regions of the shell. The crown has a front portion that is flush with the outer surface at the front region of the shell, and an intermediate portion raised from the outer surface of the side regions of the shell. The crown also has a rear portion that is flush with the outer surface at the rear region of the shell. The width of the crown increases from the front portion to the rear portion. The helmet shell includes at least one vent opening, which may be located in the crown or proximate thereto.

33 Claims, 11 Drawing Sheets

U.S. PATENT DOCUMENTS 1,449,183 A 3/1923 Johnstone
1,522,952 A * 1/1925 Goldsmith ..... 2/414
1,655,007 A 1/1928 Boettge
1,691,202 A 11/1928 Van
1,705,879 A 3/1929 Rodgers
1,868,926 A 7/1932 Tatore
2,140,716 A * 12/1938 Pryale ..... 2/414
2,354,840 A 8/1944 Seletz
2,570,182 A * 10/1951 Daly et al. ..... 264/55
2,688,747 A * 9/1954 Marx ..... 2/423
2,758,304 A * 8/1956 McGowan ..... 2/411
2,768,380 A 10/1956 Golomb
2,785,405 A 3/1957 Snyder
D180,239 S 5/1957 McMurry
2,850,740 A 9/1958 Adams
2,861,272 A 11/1958 Stuart
2,904,645 A * 9/1959 Sarles ..... 2/422
2,985,883 A 5/1961 Marietta
2,986,739 A 6/1961 Rozzi
3,039,108 A 6/1962 Lohrenz
3,113,318 A 12/1963 Marietta
3,166,761 A * 1/1965 Strohm ..... 2/421
3,167,783 A 2/1965 Wolfe
3,186,004 A * 6/1965 Carlini ..... 2/413
3,216,023 A 11/1965 Morgan
3,263,236 A * 8/1966 Humphrey ..... 2/9
3,447,162 A 6/1969 Aileo
3,548,410 A 12/1970 Parker
3,609,764 A * 10/1971 Morgan ..... 2/414
3,761,959 A * 10/1973 Dunning ..... 2/413
3,783,450 A * 1/1974 O'Connor ..... 2/421
3,793,241 A * 2/1974 Kyle et al. ..... 521/159
D230,911 S * 3/1974 Isps, Jr. ..... D29/106
3,818,508 A * 6/1974 Lammers et al. ..... 2/412
3,882,547 A * 5/1975 Morgan ..... 2/414
3,934,271 A 1/1976 Rhee
3,994,020 A 11/1976 Villari
3,994,021 A 11/1976 Villari et al.
3,994,022 A 11/1976 Villari et al.
4,023,213 A * 5/1977 Rovani ..... 2/413
4,028,743 A 6/1977 Christensen
4,060,855 A 12/1977 Rappleyea
4,075,714 A * 2/1978 Ryder et al. ..... 2/6.3
4,101,983 A * 7/1978 Dera et al. ..... 2/412
4,233,687 A * 11/1980 Lancellotti ..... 2/9
4,272,853 A * 6/1981 Schuessler ..... 2/424
4,279,038 A * 7/1981 Bruckner et al. ..... 2/425
4,287,613 A * 9/1981 Schulz ..... 2/413
D267,287 S * 12/1982 Gooding ..... D29/122
4,363,140 A * 12/1982 Correale ..... 2/9
4,370,759 A * 2/1983 Zide ..... 2/424
4,390,995 A * 7/1983 Walck ..... 2/9
4,398,306 A 8/1983 Gooding
4,404,690 A * 9/1983 Farquharson ..... 2/420
4,475,248 A 10/1984 L'Abbe et al.
4,477,929 A 10/1984 Mattsson
4,633,531 A 1/1987 Nimmons
4,646,368 A 3/1987 Infusino et al.
4,677,694 A 7/1987 Crow
4,692,947 A * 9/1987 Black et al. ..... 2/421
4,706,305 A 11/1987 Cho
4,744,107 A * 5/1988 Fohl ..... 2/422
4,774,729 A * 10/1988 Coates et al. ..... 2/424
4,794,652 A * 1/1989 Piech von Planta et al. ..... 2/414
4,808,469 A 2/1989 Hiles
4,831,668 A * 5/1989 Schulz ..... 2/414
4,837,866 A * 6/1989 Rector et al. ..... 2/424
4,853,980 A * 8/1989 Zarotti ..... 2/413
4,866,792 A 9/1989 Arai
4,885,806 A 12/1989 Heller
4,903,346 A * 2/1990 Reddemann et al. ..... 2/411
4,916,759 A * 4/1990 Arai ..... 2/414
D309,512 S 7/1990 Crow
4,947,490 A * 8/1990 Hayden ..... 2/424
5,014,365 A * 5/1991 Schulz ..... 2/412
5,035,009 A * 7/1991 Wingo et al. ..... 2/414
5,083,321 A * 1/1992 Davidsson ..... 2/421
5,093,936 A 3/1992 Copeland
5,093,939 A 3/1992 Noyerie et al.
5,101,517 A 4/1992 Douglas
5,129,108 A 7/1992 Copeland
5,136,728 A 8/1992 Kamata
5,175,889 A * 1/1993 Infusino ..... 2/413
5,177,816 A * 1/1993 Schmidt et al. ..... 2/424
5,263,203 A * 11/1993 Kraemer et al. ..... 2/413
5,263,204 A 11/1993 Butsch
5,267,353 A * 12/1993 Milligan ..... 2/9
5,293,649 A * 3/1994 Corpus ..... 2/424
RE34,699 E 8/1994 Copeland
5,347,660 A 9/1994 Zide et al.
D357,555 S 4/1995 Brueckner
5,418,257 A * 5/1995 Weisman ..... 521/54
5,461,730 A 10/1995 Carrington
D364,487 S * 11/1995 Tutton et al. ..... D29/122
5,539,936 A 7/1996 Thomas
5,553,330 A 9/1996 Carveth
D378,236 S 2/1997 Zanotto et al.
D382,671 S * 8/1997 Shewchenko ..... D29/106
5,713,082 A 2/1998 Bassette et al.
5,724,681 A 3/1998 Sykes
5,732,414 A * 3/1998 Monica ..... 2/425
5,737,770 A 4/1998 Chen
5,790,988 A 8/1998 Guadagnino, Jr. et al.
5,799,337 A * 9/1998 Brown ..... 2/421
D406,399 S 3/1999 Hohdorf
5,915,537 A * 6/1999 Dallas et al. ..... 2/410
5,930,840 A 8/1999 Arai
5,946,735 A 9/1999 Bayes
5,953,761 A 9/1999 Jurga et al.
5,963,990 A * 10/1999 White ..... 2/424
5,966,744 A 10/1999 Smith
6,047,400 A 4/2000 Spencer
6,054,005 A * 4/2000 Hurley et al. ..... 156/219
6,070,271 A * 6/2000 Williams ..... 2/412
6,073,271 A 6/2000 Alexander et al.
6,079,053 A * 6/2000 Clover et al. ..... 2/424
6,128,786 A 10/2000 Maddux
6,138,284 A 10/2000 Arai
6,189,156 B1 * 2/2001 Loiars ..... 2/424
6,199,219 B1 3/2001 Silken
6,219,850 B1 4/2001 Halstead et al.
6,226,801 B1 * 5/2001 Alexander et al. ..... 2/413
D445,962 S 7/2001 Brignone et al.
6,256,798 B1 7/2001 Egolf
6,272,692 B1 8/2001 Abraham
D448,526 S 9/2001 Brignone et al.
6,282,726 B1 * 9/2001 Noyerie et al. ..... 2/424
D448,890 S 10/2001 Brignone et al.
6,298,483 B1 10/2001 Schiebl et al.
6,360,376 B1 3/2002 Carrington
6,370,699 B1 * 4/2002 Halstead et al. ..... 2/414
D459,555 S 6/2002 Gatellet
6,438,762 B1 * 8/2002 Jenkins ..... 2/411
6,438,763 B2 * 8/2002 Guay et al. ..... 2/424
6,446,270 B1 9/2002 Durr
D465,067 S * 10/2002 Ide et al. ..... D29/106
6,481,024 B1 * 11/2002 Grant ..... 2/421
6,499,139 B1 12/2002 Brown
6,499,147 B2 12/2002 Schiebl et al.
D475,486 S * 6/2003 Ide et al. ..... D29/122
6,701,535 B2 3/2004 Dobbie et al.
D492,818 S * 7/2004 Ide et al. ..... D29/122
6,934,971 B2 * 8/2005 Ide et al. ..... 2/425
6,938,272 B1 9/2005 Brown
D511,026 S * 10/2005 Ide et al. ..... D29/107
2002/0104533 A1 * 8/2002 Kalhok et al. ..... 128/201.24
2002/0174480 A1 11/2002 Lombard
2003/0188375 A1 10/2003 Wilson
2003/0209241 A1 11/2003 Fournier

FOREIGN PATENT DOCUMENTS

DE 8321097 U 10/1983
DE 3338188 5/1985
DE 3603234 8/1987
DE 19745960 4/1999
EP 512193 11/1992
GB 256430 8/1926

| | | | |
|---|---|---|---|
| JP | 56-53735 | U | 5/1981 |
| JP | 57-205511 | | 12/1982 |
| JP | 59-37323 | U | 3/1984 |
| JP | 3-22024 | U | 3/1991 |
| JP | 05-132809 | | 5/1993 |
| JP | 5-72922 | U | 10/1993 |
| JP | 07-109609 | | 4/1995 |
| JP | 07-126908 | | 5/1995 |
| JP | 10-195707 | | 7/1998 |
| JP | 2001-020121 | | 1/2001 |
| WO | WO95/34229 | | 12/1995 |
| WO | WO01/52676 | | 7/2001 |

OTHER PUBLICATIONS

U.S. Appl. No. 10/151,245, filed May 21, 2002, Lombard.
Claim Construction Opinion and Order; *Riddell, Inc.* v. *Schutt Sports, Inc.*; U.S. District Court for the W.D. of Wisconsin; 08-cv-711; dated Jul. 10, 2009.
Schutt's Response to Riddell's First Set of Interrogatories; including patent invalidity contentions and exhibit with invalidity claim charts; dated Mar. 13, 2009.
Schutt's Answer and Affirmative Defenses; *Riddell, Inc.* v. *Schutt Sports, Inc.*; U.S. District Court for the W.D. of Wisconsin; 08-cv-711; dated Feb. 16, 2009.
Plaintiff Riddell's Brief in Support of Proposed Claim Constructions; dated Apr. 29, 2009.
Plaintiff Riddell's Opinion Brief to Defendant Schutt's Proposed Claim Constructions; dated May 18, 2009.
Defendant Schutt's First Supplemental Responses to Plaintiff Riddell's First Set of Interrogatories.

* cited by examiner

FIG. 1
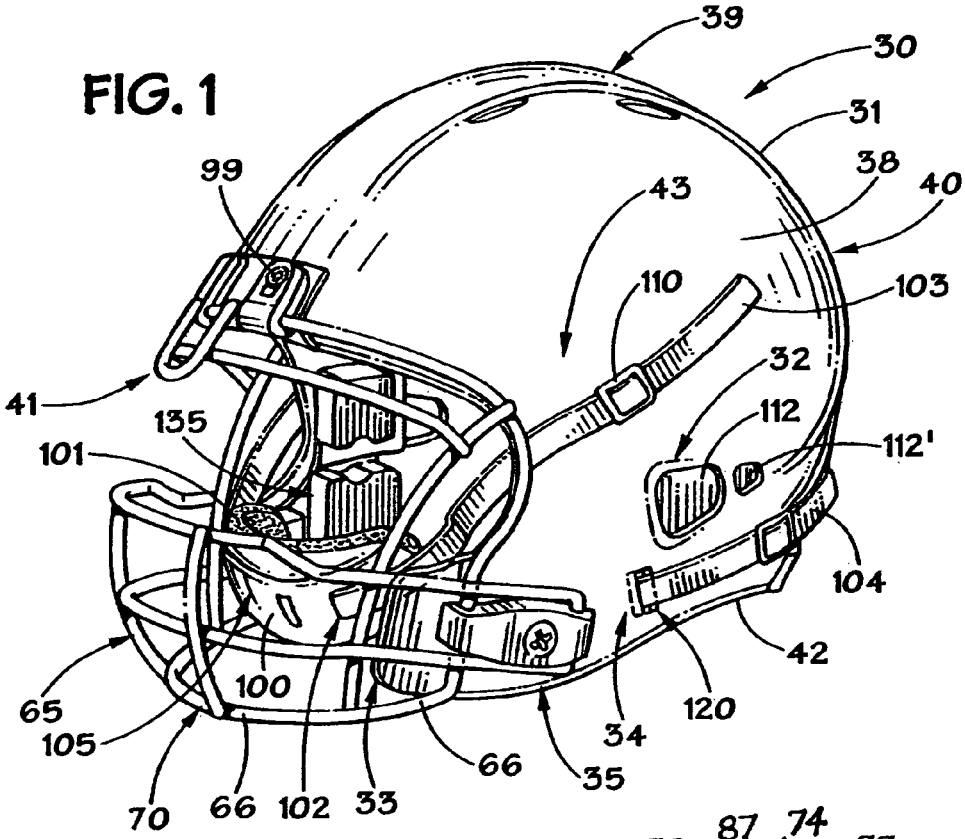
FIG. 3
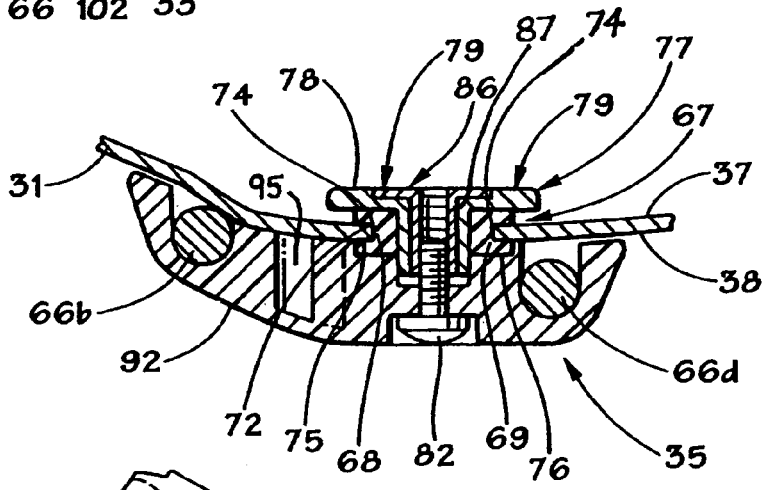
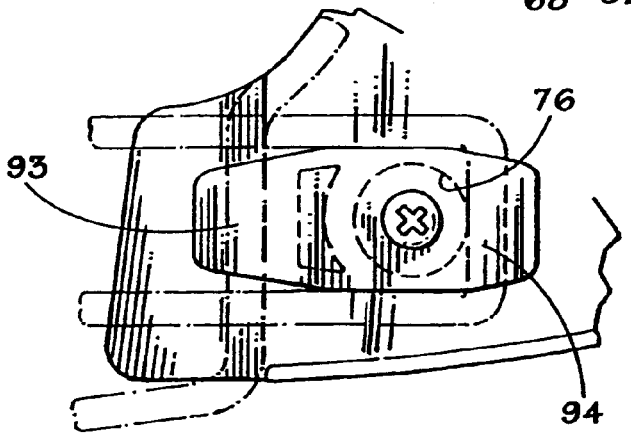
FIG. 4

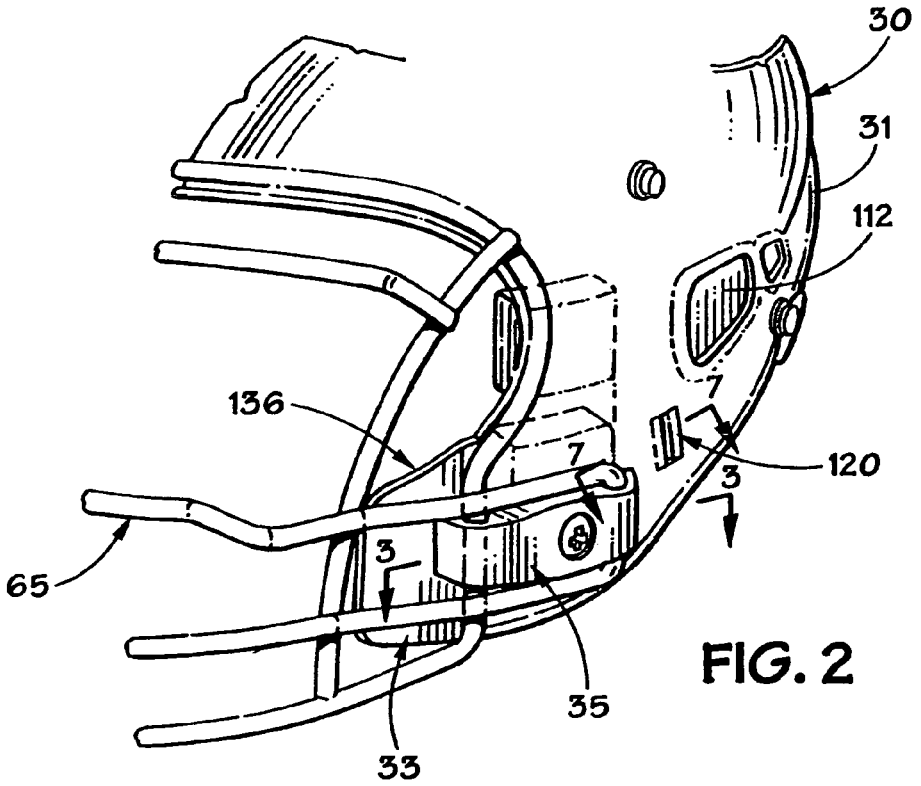
FIG. 2
FIG. 5
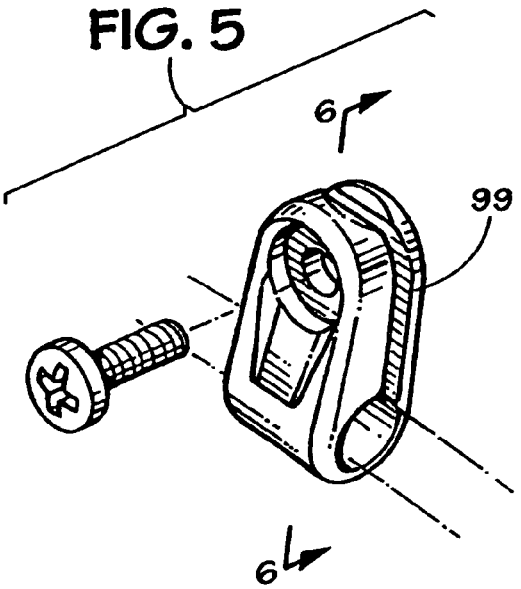
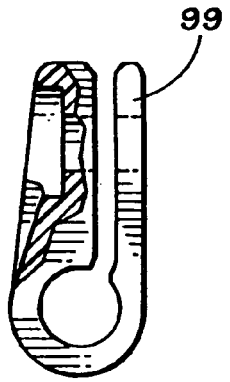
FIG. 6
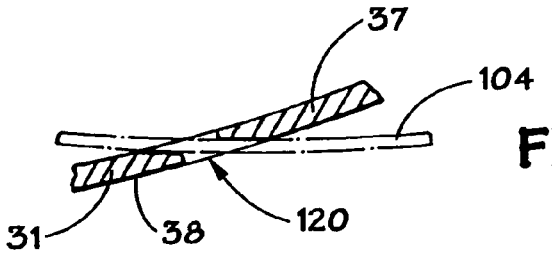
FIG. 7

FIG. 12
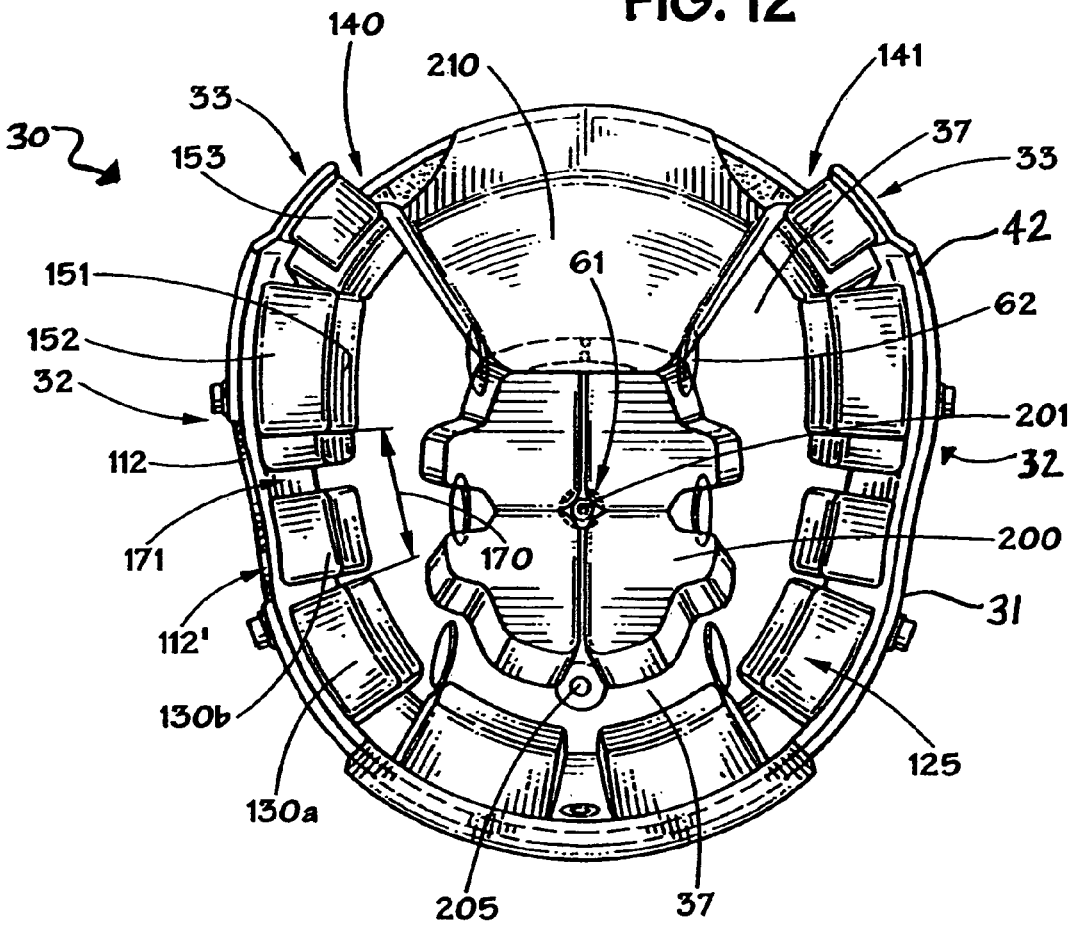
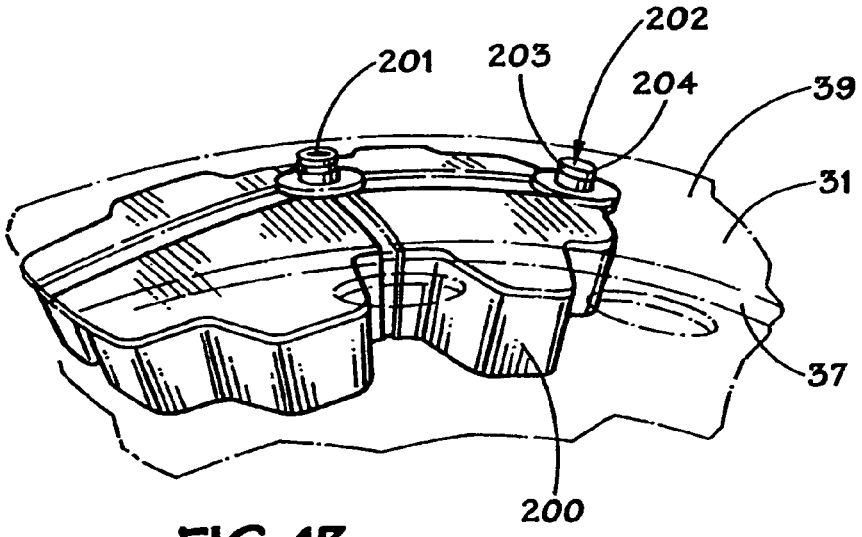
FIG. 13

FIG. 18
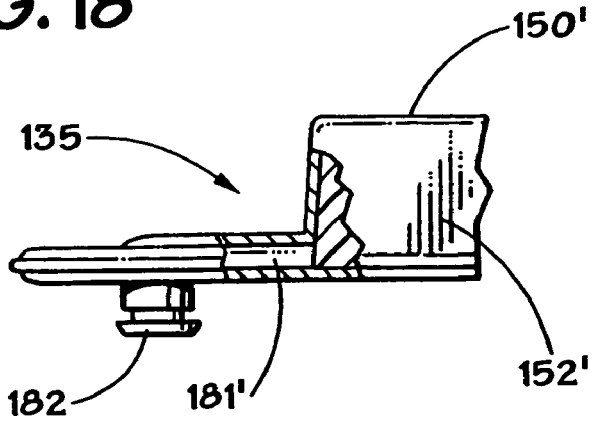
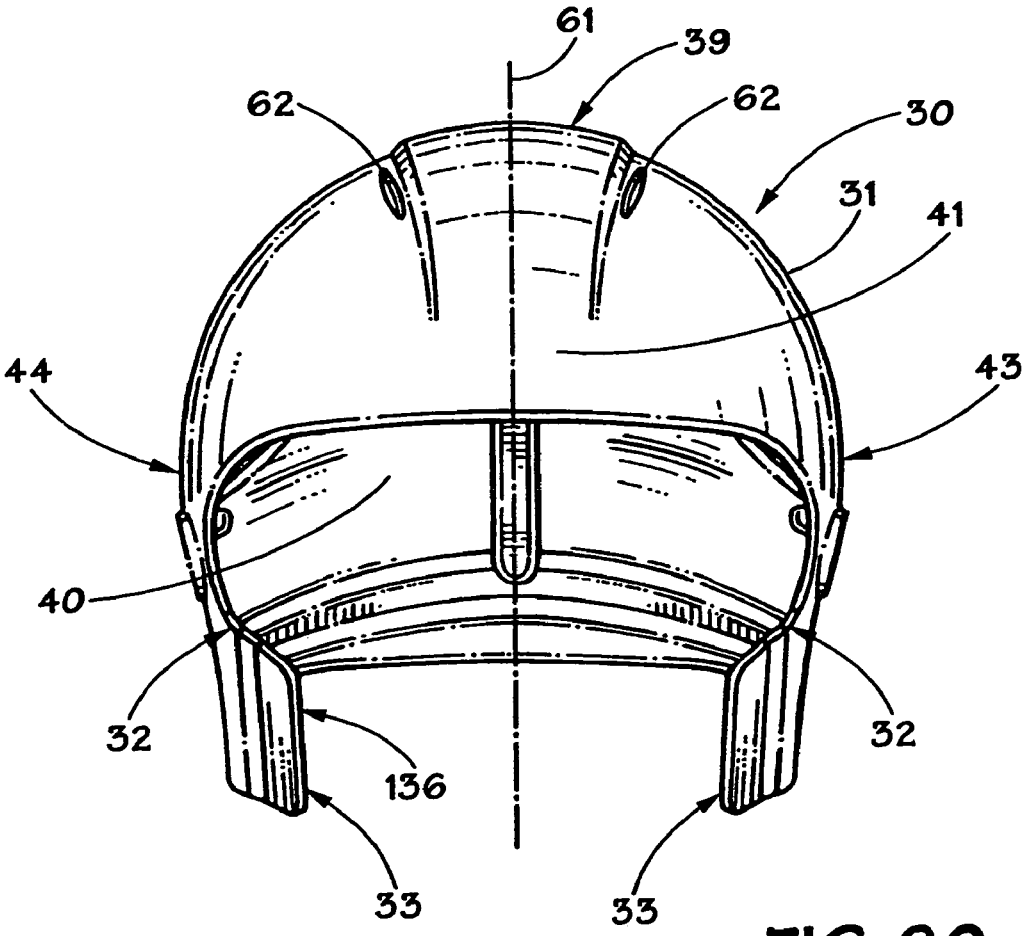
FIG. 20

SPORTS HELMET

CROSS-REFERENCE TO RELATED APPLICATIONS

This Application is a divisional application of U.S. application Ser. No. 11/208,233, filed on Aug. 18, 2005, now U.S. Pat. No. 7,240,376, which is a continuation application of U.S. application Ser. No. 10/427,236, filed May 1, 2003, now U.S. Pat. No. 6,934,971, which claims the benefit of Provisional Patent Application No. 60/376,898, filed May 1, 2002, which applications are incorporated herein by reference and made a part hereof.

TECHNICAL FIELD

The invention generally relates to a sports helmet, such as a football, lacrosse, hockey or baseball helmet.

BACKGROUND OF THE INVENTION

Various activities, such as contact sports, and in particular the sport of football, require the use of helmets to attempt to protect participants from injury to their heads due to impact forces that may be sustained during such activities. Various types of helmets have been in use in the sport of football, ever since individuals began wearing helmets to attempt to protect their heads many years ago. Typically, these helmets have included: an outer shell, generally made of an appropriate plastic material, having the requisite strength and durability characteristics to enable them to be used in the sport of football; some type of shock absorbing liner within the shell; a face guard; and a chin protector, or chin strap, that fits snugly about the chin of the wear of the helmet, in order to secure the helmet to the wearer's head, as are all known in the art.

Over the years, various improvements have been made to the various components of a football helmet; however, in general, the overall configuration and shape of a football helmet, has remained the same for many years. In this regard, a typical football helmet has included an ear flap as a part of the shell forming the helmet, and the ear flap generally overlies an ear of the wearer and a portion of a cheek of the wearer; however, the jaw of the wearer typically extends outwardly beyond the outer periphery of the helmet, whereby a majority portion of the jaw of the wearer has only been protected by the chin protector.

In general, conventional football helmets presently have ear flaps and the lower portions thereof taper inwardly toward the neck and rearmost portions of the player's jawbone overlied by the ear flaps. As a consequence of this structure, when a player removes his, or her, helmet, it is necessary to pull the sides, or ear flaps, of the helmet outwardly so that the helmet may clear the player's ears. Further in this regard, conventional helmets may also include pads adjacent the player's ear and these pads generally are located along the lower and front edge of the ear flap. These pads must also be pulled away from the ears of the player when removing a conventional helmet. The repeated putting on, and taking off, a football helmet may cause irritation to the player's ear. It would be desirable if the putting on, and removal of, a football helmet did not cause repeated sliding frictional contact with a player's ears, to prevent potential irritation to the player's ear.

Conventional football helmets utilize face guards which are generally made of either a metallic or thermoplastic material. Since a player wears a helmet for a considerable period of time during practices and games, it would be desirable to minimize the weight of the helmet, while not sacrificing protection. The face guards of conventional helmets are typically attached to the sides of the helmet, as well as upon the front of the helmet. Thus, the face guard must extend rearwardly in order to be attached to the side of the helmet. It would be desirable if the size of the face guard could be reduced, thereby reducing the weight of the face guard used in the helmet.

While it is the desire and goal that a football helmet, and other types of protective helmets, prevent injuries from occurring, it should be noted that as to the helmet of the present invention, as well as prior art helmets, due to the nature of the sport of football in particular, no protective equipment or helmet can completely, totally prevent injuries to those individuals playing the sport of football. It should be further noted that no protective equipment can completely prevent injuries to a player, if the football player uses his football helmet in an improper manner, such as to butt, ram, or spear an opposing player, which is in violation of the rules of football. Improper use of a helmet to butt, ram, or spear an opposing player can result in severe head and/or neck injuries, paralysis, or death to the football player, as well as possible injury to the football player's opponent. No football helmet, or protective helmet, such as that of the present invention, can prevent head, chin, or neck injuries a football player might receive while participating in the sport of football. The helmet of the present invention is believed to offer protection to football players, but it is believed that no helmet can, or will ever, totally and completely prevent head injuries to football players.

The football helmet of the present invention, when compared to previously proposed conventional football helmets, has the advantages of: being designed to attempt to protect a wearer of the helmet from injuries caused upon an impact force striking the helmet; preventing irritation to a player's ear; affording more protection to the jaw of the wearer; and providing for the use of a lighter weight face guard.

SUMMARY OF THE INVENTION

In accordance with the invention, the foregoing advantages are believed to have been achieved by the football helmet of the present invention. The football helmet of the present invention may include: an outer shell having an inner wall surface and an outer wall surface, the shell including a crown, a back, a front, a lower edge surface, and two sides, the shell being adapted to receive the head of wearer of the helmet, the wearer having a lower jaw having two side portions; each side of the shell includes an ear flap adapted to generally overlie an ear and a portion of a cheek of the wearer; each ear flap generally extending downwardly from its respective side; each ear flap including a jaw flap attached to the ear flap, each jaw flap extending from the ear flap forwardly toward the front of the shell and adapted to generally extend to overlie a side portion of the lower jaw of the wearer of the helmet; each side having a chin protector connector, adapted to connect a portion of a chin protector to the shell; each side having a face guard connector, adapted to connect a portion of a face guard to the shell; and a liner connector, adapted to connect a shock absorbing liner to a portion of the inner wall surface of the shell. Another feature of the present invention is that there may be a face guard connected to at least both sides of the helmet by the face guard connectors, each face guard connector including a shock absorber member adapted to substantially omni-directionally distribute an impact force, exerted upon the face guard, throughout the shell. A further feature of this aspect of the present invention is that each shock absorber member may be a grommet disposed in an opening formed in a side of the shell.

In accordance with another aspect of the present invention, the football helmet may include a chin protector having two sides and at least two flexible members associated with each side of the chin protector, the at least two flexible members adapted to engage with one of the chin protector connectors on the sides of the shell. Another feature of this aspect of the invention is that the chin protector connector may include at least two notches formed in the lower edge surface of the shell, with at least one notch being disposed on each side of the shell, and at least one of the flexible members on each side of the chin protector passes through at least one of the notches on each side of the shell. A further aspect of the invention is that the at least two notches may be disposed in the lower edge surface of the shell adjacent each ear flap of the shell. An additional feature of this aspect of the invention is that the chin protector connector may include at least one slot formed in each side of the shell, and at least one of the flexible members on each side of the chin protector passes through the at least one slot.

In accordance with another aspect of the present invention, the football helmet may include a shock absorbing liner associated with the inner wall surface of the shell by the liner connector. An additional feature of this aspect of the present invention is that the shock absorbing liner may include a plurality of resilient members adapted to absorb shock forces exerted upon the shell, and the plurality of resilient members may be disposed along the inner wall surface of the back and sides of the shell, including at least one resilient pad member disposed upon the inner wall surface of a portion of each of the jaw flaps of the shell. A further feature of this aspect of the present invention is that each of the at least one resilient pad members may be formed integral with the plurality of resilient members, or at least one resilient pad member may be releaseably secured to the plurality of resilient members. An additional feature of this aspect of the present invention is that on each side of the inner wall surface of the shell, an ear channel may be formed between at least one of the resilient members of the shock absorbing liner and the at least one resilient pad member disposed upon the inner wall surface of a portion of the jaw flap, and each ear channel may be disposed adjacent an ear opening formed in each flap.

Another aspect of the present invention is that the outer shell may have a vertical, longitudinal axis extending downwardly from the crown of the helmet, and each ear flap may generally lie in a plane which is substantially parallel to the longitudinal axis of the outer shell. Another feature of this aspect of the present invention is that the outer shell of the helmet may have a vertical, longitudinal axis extending downwardly from the crown, and each jaw flap may generally lie in a plane which is substantially parallel to the longitudinal axis of the outer shell.

The football helmet of the present invention, when compared with previously proposed conventional football helmets, is believed to have the advantages of: offering protection to football players against injuries caused by impact forces exerted upon the football helmet during the playing of the game of football; providing a football helmet which is easier for the wearer of the helmet to put on and take off, and may minimize irritation to a player's ear; providing protection for the jaw of the wearer; and providing a smaller, thus lighter in weight, face guard.

Other features and advantages of the invention will be apparent from the following specification taken in conjunction with the following drawings.

BRIEF DESCRIPTION OF THE DRAWINGS

FIG. 1 A is perspective view of another embodiment of a sports helmet showing a face guard of the present invention;

FIG. 2 is a partial perspective view of the helmet and face guard of FIG. 1;

FIG. 3 is a cross-sectional view taken along line 3-3 of FIG. 2, showing an embodiment of the face guard and a face guard connector of the present invention;

FIG. 4 is a partial side view of the face guard and the connector of FIG. 3;

FIG. 5 is a perspective view of a face guard mounting clip of FIGS. 1A and 1B;

FIG. 6 is a cross-sectional view of the face guard mounting clip of FIG. 5, taken along line 6-6 of FIG. 5;

FIG. 7 is a partial cross-sectional view of the football helmet of FIGS. 1 and 2, taken along line 7-7 of FIG. 2;

FIG. 12 is a bottom view of the football helmet of FIGS. 1 and 8, with the face guard removed;

FIG. 13 is a partial perspective view of the crown of the football helmet of FIGS. 1 and 1A, showing a crown pad in accordance with the present invention;

FIG. 18 is a partial cross-sectional view of the resilient pad member of FIG. 15 taken along line 18-18 of FIG. 15;

FIG. 20 is a front view of the football helmet of the present invention of both FIGS. 1 and 1A.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

Figure 1A:
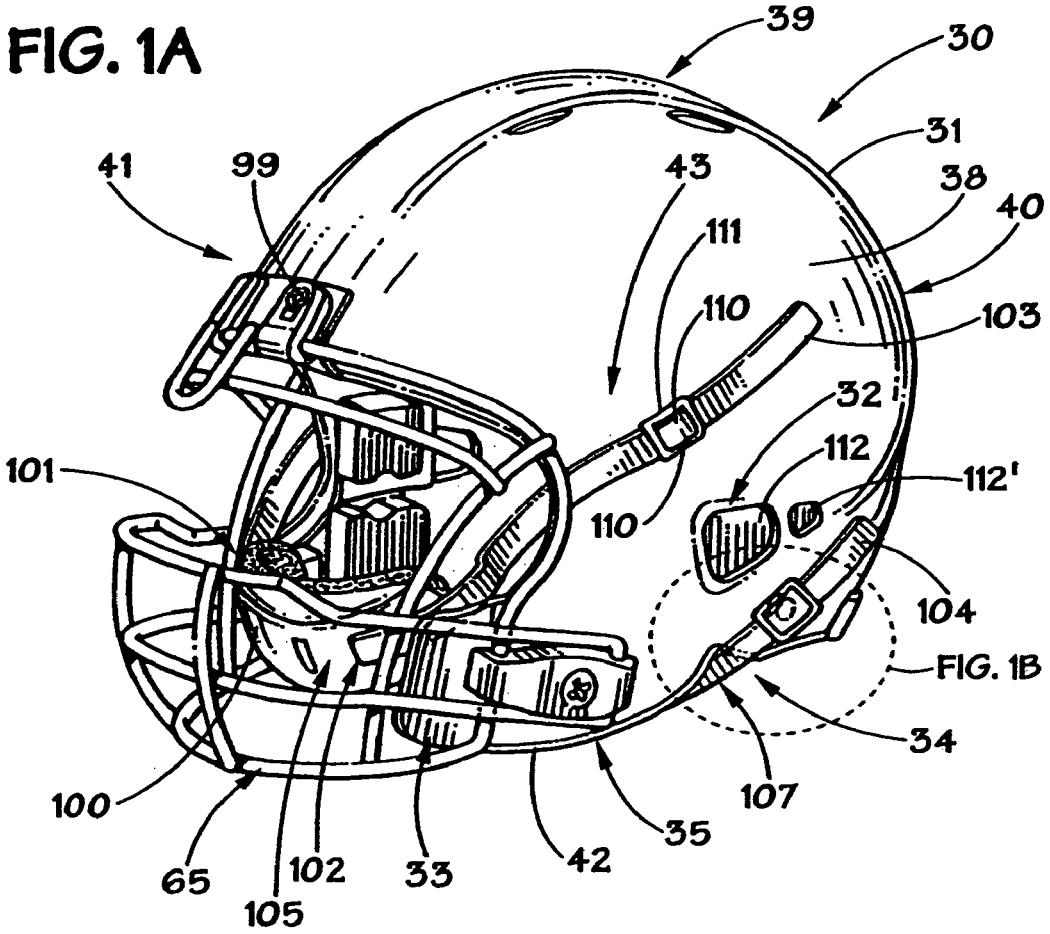
FIG. 1 is a perspective view of an embodiment of a sports helmet showing a face guard of the present invention.
FIG. 1B is a perspective view of the portion of the helmet of FIG. 1A shown within dotted lines 1B.
Figure 19:
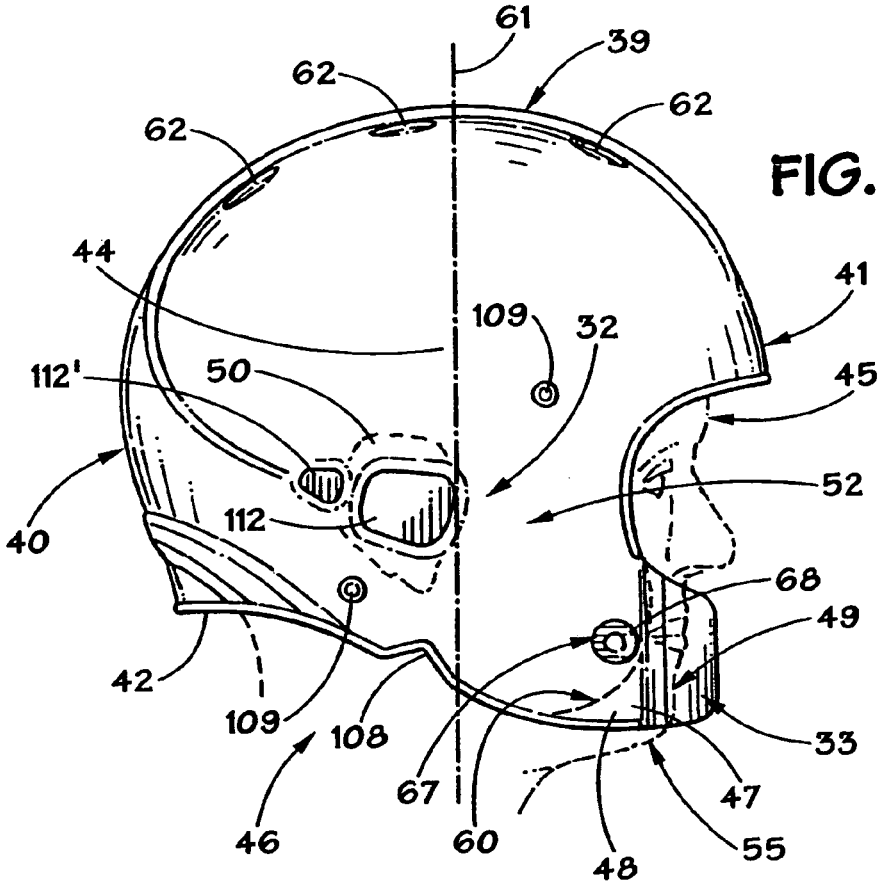
FIG. 19 is a side view of the helmet of the present invention, illustrating the chin protector connecter of the football helmet of FIG. 1A, including a wearer of the helmet being partially shown in phantom lines, including a general outline of a conventional ear flap being also shown in phantom lines.

In FIGS. 1, 1A, and 19, a football helmet 30 in accordance with the present invention is shown to generally include: an outer shell 31, ear flap 32, each ear flap 32 including a jaw flap 33, a chin protector connector 34, a face guard connector 35, and a liner connector (not shown). Outer shell 31 is preferably made of any suitable plastic material having the requisite strength and durability characteristics to function as a football helmet, or other type of protective helmet, such as polycarbonate plastic materials, one of which is known as LEXAN®, as is known in the art. Outer shell 31 has an inner wall surface 37 (FIG. 12) and an outer wall surface 38. Shell 31 further includes a crown 39, a back 40, a front 41, a lower edge surface 42, and two sides 43 (FIGS. 1 and 1A) and 44 (FIG. 19). As is known in the art, and as will be hereinafter described in greater detail, shell 31 is adapted to receive the head 45 of a wearer 46 of the helmet 30, the wearer 46 having a lower jaw 47 (FIG. 19) having two side portions 48 (FIG. 19), only the right side portion 48 of jaw 47 being illustrated. As shown in FIG. 19, the lower jaw 47 terminates generally adjacent to the chin 49 of the wearer's head 45 toward the front of the head 45, and the lower jaw, or mandible 47, generally ends its connection with the upper jaw generally adjacent, and forwardly of ears 50 of wearer 46.

Still with reference to FIGS. 1, 1A and 19, each side 43, 44 of the shell 31 includes an ear flap 32, the left ear flap 32 being shown in FIGS. 1 and 1A and the right ear flap 32 being illustrated in FIG. 19, and ear flaps 32 are adapted to generally overlie an ear 50 (FIG. 19) and portion of a cheek 52 of the wearer 46. Each ear flap 32 generally extends downwardly from its respective side 43, 44, and in general extends in a direction extending from crown 39 downwardly toward the lower edge surface 42 of shell 31. Each ear flap 32 includes a jaw flap 33, the left hand jaw flaps 33 being illustrated in FIGS. 1 and 1A, and the right jaw flap 33 being illustrated in FIG. 19. Each jaw flap 33 extends from it corresponding ear flap 32 forwardly toward the front 41 of the shell 31, and as seen in FIG. 19 as adapted to generally extend to overlie a side portion 48 of the lower jaw 47 of the wearer 46 of the helmet.

As shown in FIG. 19, jaw flap 33 is shown to extend forwardly to overlie a forwardly disposed portion 55 of lower jaw 47 disposed toward the chin 49 of wearer 46. As illustrated in FIG. 19, jaw flap 33 extends forwardly enough to overlie the side of the chin 49 of wearer 46. In this regard, it should be noted that helmets 30 of the present invention are generally made with outer shells 31 of varying sizes, dependent upon the size of the head of the particular wearer of the helmet. In FIG. 19, helmet 30 is shown superimposed upon what is believed to be an average size head of a wearer of the helmet 30, whereby jaw flap 33 is shown to generally overlie the entire side portion 48 of lower jaw 47, including the forwardly disposed portion 55 of lower jaw 47 adjacent the chin 49 of wearer 46, including overlying the side of the chin 49 of wearer 46. Since FIG. 19 is not a representation of all sizes of heads and all types of chin structures, such as chins which may greatly extend outwardly away from the head of the wearer, it should be understood that it is perhaps possible that someone wearing a helmet 30 in accordance with the present invention may have a slight side portion of his or her chin extending outwardly beyond the outer periphery of jaw flap 33. It is believed that jaw flap 33 will overlie at least the forwardly disposed portion 55 of the lower jaw 47 of virtually all wearers of helmets 30. In this regard, the outer periphery 60, shown in phantom lines in FIG. 19, of a conventional ear flap, without the jaw flap 33 of the present invention generally does not overlie a forwardly disposed portion 55 of the lower jaw, or mandible, 47 of a wearer of a conventional helmet. Furthermore, the ear flap of a conventional football helmet virtually never overlies the chin 49 of a wearer of a conventional helmet.

With reference to FIGS. 12, 19, and 20, the outer shell 31 has a vertical, longitudinal axis 61 generally extending downwardly from crown 39, and each ear flap 32 generally lies in a plane which is substantially parallel to the longitudinal axis 61 of shell 31. Similarly, each jaw flap 33 also generally lies in a plane which is substantially parallel to the longitudinal axis 61 of the outer shell 31. The crown 39 of shell 31 may be provided with at least one, and preferably a plurality of ventilation openings, or air vents, 62, which permits the passage of air through shell 31. Vents 62 permit air adjacent the head 45 of wearer 46, which has been heated by being in contact with head 45, to be vented and passed outwardly through openings 62, which may contribute to greater comfort being afforded the wearer 46 of helmet 30. As shown in FIG. 12, the lower edge 42 of the shell 31 defines a circumference, and the shell 31 is configured such that the terminal ends of the jaw flaps 33 reside in the same or single quadrant of an X-Y coordinate system.

Figure 8:
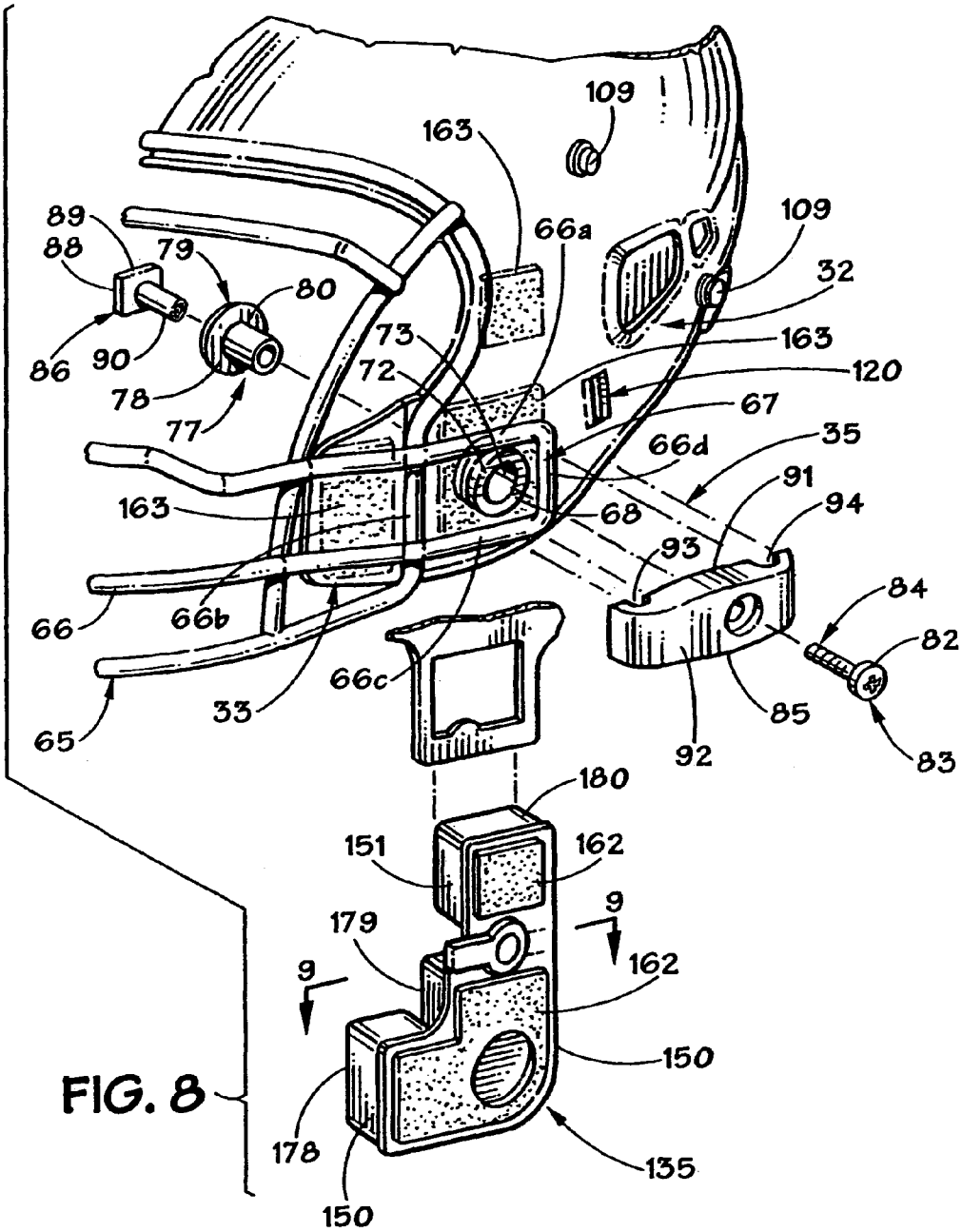
FIG. 8 is a partial exploded view of the football helmet and the face guard of the present invention.
Figure 15:
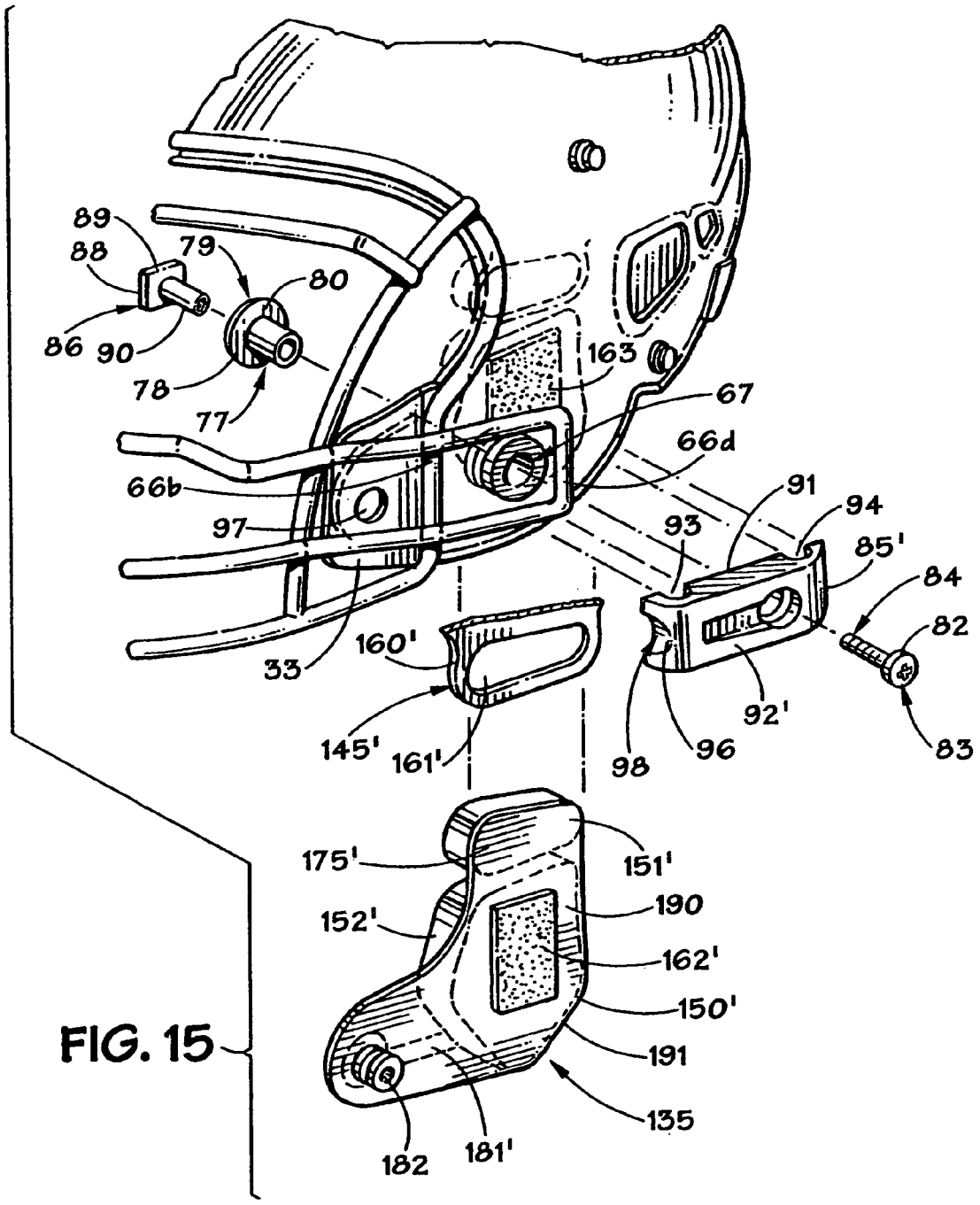
FIG. 15 is a partial exploded perspective view of the helmet and the face guard of the present invention.
Figure 17:
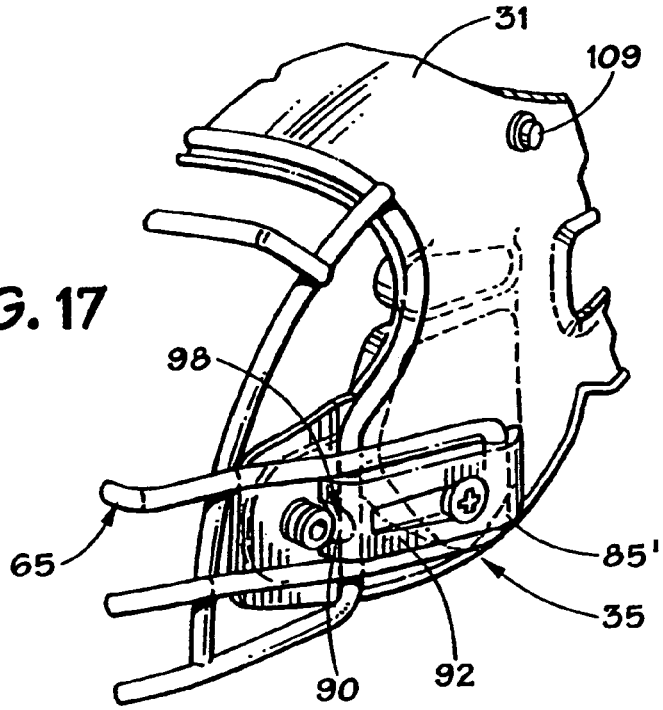
FIG. 17 is a partial perspective view of the face guard and the helmet of FIG. 15.

With reference to FIGS. 1, 1A, 8, and 15, the face guard connector 35 of the present invention will be described in greater detail. Face guard 65 is formed of a plurality of wire members 66, which may be formed of any suitable material having the requisite strength and durability characteristics to function as a football helmet face guard, as is known in the art. The wire members 66 may be preferably formed of a metallic material, such as any suitable steel, and as is known in the art, the wire members 66 may be provided with a suitable plastic coating. Additionally, the wire members 66 may be of a solid or tubular cross-sectional configuration. Alternatively, wire members 66 may be formed of any suitable plastic material, this material also having the requisite strength and durability characteristics to perform the functions of a football helmet face guard. The face guard connectors 35 are adapted to connect a portion of the face guard 65 to shell 31. A face guard connector 35 is disposed on each side 43, 44 of shell 31. One embodiment of face guard connector 35 is shown in FIGS. 1, 1A and 8, while another embodiment of face guard connector is illustrated in FIGS. 15 and 17. In general, the two embodiments of face guard connector 35 are substantially similar, whereby the same components will be described with identical reference numerals, and primed reference numerals will be used in connection with components having the same, or similar functions, but different structures or configurations.

The details of the face guard connector 35 used in connection with the helmet 30 of FIGS. 1, 1A, 2 and 8, are illustrated in FIGS. 3 and 4, whereas the details of construction of the face guard connector 35 of FIG. 15 is illustrated in FIGS. 15 and 17. With reference to FIGS. 3, 4, 8, and 15, face guard connector 35 of the present invention is shown to include a shock absorber member 67 adapted to substantially omni-directionally distribute an impact force, exerted upon the face guard 65, through shell 31. Preferably, each shock absorber member 67 is a grommet 68 disposed in an opening 69 formed in a side 43, 44 of shell 31. Grommet 68 may be formed of rubber, or any other suitable elastomeric material which will function so as to permit substantially omni-directionally distribution of an impact force, exerted upon the face guard 65, throughout shell 31 of helmet 30. Preferably, grommet 68 is formed of synthetic rubber. In this regard, face guard 65 can incur impact forces in a variety of directions during a game of football. For example, as a player strikes the ground upon being tackled, his or her face guard might strike the ground at the lower most center 70 (FIG. 1) of face guard 65, which would be an upwardly exerted force upon face guard 65. Similarly, another player's helmet, or hand, might push downwardly upon the wire member 71 (FIG. 1) of face guard 65, thus exerting a downwardly extending impact force upon face guard 65. Additionally, a player's face guard could be struck in the direction from one of the sides 43, 44 of helmet 30, which would be a side or lateral impact force being exerted upon face guard 65. Of course, it would be readily apparent to one of ordinary skill in the art that an impact force could be exerted upon face guard 65 from any direction in which it is possible to strike, or impact against, face guard 65. As will be hereinafter described in greater detail, as an impact force is exerted upon face guard 65, the shock absorber member 67, or grommet 68, functions to absorb, or attenuate, the impact force exerted upon the face guard, and to substantially omni-directionally distribute the impact force through the shell 31.

Grommet 68 may be a circular shaped member 72 with an opening 73 passing there through. As seen in FIG. 3, each circular shaped member 72 may include an inner, annular, or circular shaped lip 74 that abuts the inner wall surface 37 of the shell 31, and outer, annular shaped lip 75 that abuts the outer wall surface 38 of the shell 31. Each of the face guard connectors 35 has a recess 76 (FIG. 4) which receives a portion of the grommet 68 in a close fitting, abutting relationship as seen in FIG. 3. Preferably, the outer, annular shaped lip 75 is received in the recess 76. As shown in FIGS. 3, 8, and 15, a bushing 77 may be disposed within the opening 73 which passes through grommet 68. Preferably, the bushing is made of a suitable plastic material having the requisite strength and durability characteristics to function as part of a football helmet face guard connector. Preferably, bushing 77 is formed of a thermoplastic material, such as SURLYN®. Bushing 77 may include a cap member 78 having an upper wall surface 79 (FIG. 3) and a lower wall surface 80 (FIGS. 8 and 15), with the lower wall surface 80 being disposed adjacent the inner wall surface 37 of the shell 31. A bolt 82 having first and second ends 83, 84 may be passed through each bushing and the face guard connector body members, or clips, 85, 85' of each face guard connector 35. A nut 86 receives the second end 84 of the bolt 82.

By bolt 82 being rotatably threaded and rotated with respect to nut 86, face guard 65 may be secured to each side 43, 44 of shell 31. It should be noted that although bolt 82 is inserted from the outside of shell 31, its disposition could be reversed, although it is preferred to be inserted from outside the shell, for ease of removal should a player be injured and it becomes necessary to remove face guard 65. The upper wall surface 79 of each cap member 78 may include a recess 87 which receives a corresponding nut 86. The recess 87 of the cap member 78 preferably matingly receives the corresponding nut 86 and the recess 87 restricts rotational movement of the nut with respect to the shell 31. Preferably, the nut 86 is a I-nut 88, which includes an upper rectangular shaped member 89 and a threaded cylindrical member 90 which is received and disposed within bushing 77.

Each of the face guard connectors 35 of the present invention include a face guard connector body member 85, 85'. With reference to FIGS. 3, 4, and 8, face guard connector body member 85 will be described. Face guard connector 85 has an inner surface, or inner wall surface, 91, and outer surface, or outer wall surface, 92. Each face guard connector body member 85 has at least two channels 93, 94, disposed in a substantially parallel, substantially non-collinear relationship, each channel 93, 94 receiving a portion of the face guard 65. Preferably, face guard 65 on both of its sides includes a plurality of wire members having a substantial rectangular shaped opening, such as is formed by wire members 66*a*, 66*b*, 66*c* and 66*d* as shown in FIG. 8, with wire members 66*b* and 66*d* being received within channels 93, 94, respectively. Preferably, at least one of the channels 93, 94, is formed in the inner surface 91 of the face guard connector body member 85 and the wire member 66*b*, 66*d* is received within the at least one channel, whereby the wire member 66*b*, 66*d*, is disposed between the inner surface 91 of the face guard connector body member 85, and the outer wall surface 38 of shell 31. Preferably, as shown in FIGS. 3 and 8, both channels, 93, 94 are formed in the inner surface 91 of the face guard connector body member 85. Face guard connector body member 85, as well as face guard connector body member 85', to be hereinafter described, may be made of any suitable material having the requisite strength and durability characteristic to function as part of a face guard connector, such as a thermoplastic material being preferred. An opening 95 may be formed in the face guard connector body member 85 to provide flexibility to body member 85 so that it can more readily conform to the outer contour of the shell 31.

With reference to FIGS. 15 and 17, it is seen that face guard body member 85' is similar in design to that of body member 85. Body member 85' differs from that of body member 85, in that body member 85' includes an access passageway 96 formed in the outer surface 92' of body member 85'. Access passageway 96 is aligned with an inflation port 97 disposed in shell 31, and is adapted to provide access to inflation port 97 and permit the shock absorbing liner, to be hereinafter described, to be inflated. Access passageway may be a semi-circular shaped notch 98 formed at one end of body member 85'.

Helmet 30 as seen in FIGS. 1 and 1A may be provided with conventional face guard clips 99, only one of which is illustrated in FIGS. 1 and 1A, which are used to secure the upper portion of face guard 65 to the front 41 of shell 31. The details of construction of face guard clips 99 are shown in FIGS. 5 and 6. Upon the removal of bolts 82 from face guard connectors 35 and the removal of face guard connector body members 85, 85', face guard 65 may be rotated upwardly about face guard clips 99, in the event that it is necessary to gain access to the face of a player, or to better assist in removing the helmet 30 of a player. In this regard, no tools, other than a screw driver are necessary to remove bolts 82 and face guard connector body members 85, 85'. The frictional forces between bushing 77 and nut 86 restrain nut 86 from rotation while bolt 82 is being unthreaded there from.

Although the face guard connector 35 of the present invention has been described in particular with respect to its use with a football helmet 30, it should be noted that face guard connector 35 could, and in particular, its shock absorber member 67 could be utilized in connection with other types of protective helmets. For example, other types of helmets, with which a face guard of some type is used, include for example, lacrosse helmets, hockey helmets, and baseball batter's helmets, among others.

With reference to FIGS. 1 and 1A, each helmet includes a chin protector connector 34 for connecting a portion of a chin protector 100 to shell 31. Chin protector 100 may be of conventional design and has two sides 101, 102 and at least two flexible members 103, 104 associated with each side 101, 102 of the chin protector. Only flexible members 103, 104, associated with side 102 of chin protector 100 are illustrated. The at least two flexible members, or strap members, 103, 104 are adapted to engage with one of the chin protector connectors 34 on the sides 43, 44 of shell 31. Chin protector 100 may include a conventional chin cup 105 as is known in the art. Two embodiments of chin protector connectors 34, in accordance with the present invention, are shown in FIGS. 1 and 1A.

Figure 1B:
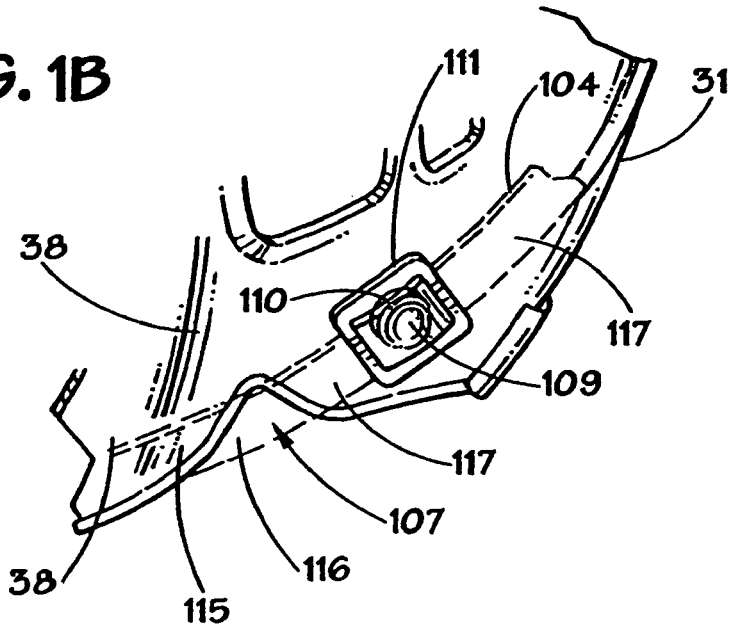

With respect to FIGS. 1A, 1B, 15, and 19, chin protector connector 34 includes at least two notches 107, 108 (FIG. 19) formed in the lower edge surface 42 of shell 31, with at least one notch being disposed on each side 43, 44 of the shell 31. As shown in FIGS. 1A. and 1B, at least one of the flexible members 103, 104 on each side of the chin protector 100 passes through at least one 107 of the notches 107, 108 on each side 43, 44 of the shell 31. Preferably, only one notch is formed in the shell 31 on each side 43, 44 of the shell; however, if desired, additional notches could be formed on the sides of the shell. Preferably, notches 107, 108 are generally V-shaped notches; however, other shapes of notches, if desired, could be utilized. As shown in FIGS. 1A and 1B, flexible member, or flexible strap member 104 passes through notch 107. As is known in the art, chin protector 100 has upper and lower flexible members 103, 104, on each side, and the upper flexible members, or flexible strap members 103 are releaseably secured to the shell 31 as by a conventional snap connector, the male portion of the snap 109 (FIGS. 15 and 19), cooperating with a female snap connector 110 carried by a bracket 111 mounted on upper strap 103 (FIG. 1A).

Helmets 30 are each provided with an ear opening 112 in each ear flap 32, and the ear openings 112 are adapted to be disposed adjacent an ear 50 of the wearer 46 permit the transmission of sound to the wearer 46. Ear openings 112 may be provided with a generally rounded configuration, with ear openings 112 generally having a truncated triangular shaped configuration with an additional smaller opening 112' being disposed rearwardly of the main ear opening 112. Preferably the notches 107, 108 are disposed in the lower edge surface 42 of the shell 31, and as seen in FIG. 19, and the notches 107, 108 are preferably disposed substantially, directly below the ear openings 112. As seen in FIGS. 1A and 1B, a first portion 115 of each lower flexible member 104 is disposed adjacent the inner wall surface 37 of shell 31, a second portion 116 of strap member 104 passes through notch 107, and a third portion 117 of the flexible member, or lower strap member 104 is disposed adjacent the outer wall surface 38 of shell 31. The third portion 117 of each lower strap member 104 is preferably releaseably secured to a portion of the chin protector connector 34 disposed on the outer wall surface 38 of shell 31. Preferably, strap 104 is releaseably secured by a male and female snap connector 109, 110, and bracket 111, as previously described. The foregoing described chin protector 100 is generally referred to as a 4 point hookup, or a "high hookup" chin protector, or chin strap, which is believed to provide better stability of the helmet 30 with respect to the wearer's head, particularly upon the player sustaining an impact force to helmet 30.

Because as previously described, the ear flaps 32 of the present invention are generally disposed to lie in a plane which is substantially parallel to the longitudinal axis 61 of the outer shell 31, the notches 107, 108 of chin protector connector 34 serve to provide improved stability of the lower chin straps, or flexible members 104, by preventing the lower strap 104 from being free to slide around the outer wall surface of ear flaps 32. The notches 107, 108 are believed to effectively "catch" the lower strap member 104 to prevent the free sliding of the lower chin strap 104. In general, if a helmet 30 is subjected to a downward impact force upon face mask 65, helmet 30 tends to roll forwardly around a virtual pivot point located slightly above the ear openings 112. This rolling effect is typically resisted by a force acting between the lower strap connectors 109, 110 and the chin 49 of the wearer of the helmet. The further away from the virtual pivot point the lower snap connection of lower chin strap 104 is located, the better the resistance of the helmet 30 to rolling. Notch 107 assists in resisting the undesired rolling effect by redirecting the strap's force line of action to a location farther away from the virtual pivot point.

With reference to FIGS. 1 and 2 and 7, another embodiment of the chin protector connector 34 of the present invention will be described. In this embodiment, chin protector connector 34, at least one slot 120 is formed in each side 43, 44 of shell 31, and at least one of the flexible members 103, 104, passes through the at least one slot 120. Preferably, the at least one slot 120 is formed in each side 43, 44 of shell 31, and the at least one slot 120 is disposed in each ear flap 32 of shell 31. Preferably, only one slot 120 is provided for each side of the shell 31. Additionally, the at least one slot 120 is preferably disposed forwardly of each ear opening 112 and is positioned between the front 41 of the shell and each ear opening 112. As shown in FIG. 7, slot 120 is tapered with respect to the inner and outer wall surfaces 37, 38 of the shell, whereby sharp edges are avoided which could damage flexible member or strap member, 104. Strap member 104 is also releaseably secured to shell 31 as by use by a female and male snap connector and bracket 109-111, as previously described. Upon releasing the lower snap connections associated with lower strap members 104, the chin protector 104 may be loosened with respect to the chin of the wearer of the helmet, whereby the wearer of the helmet may remove helmet 30 from his or her head. It is not necessary to disengage, or unsnap, the upper flexible strap members 103, in order to remove helmet 30.

Helmets 30 of the present invention preferably include a shock absorbing liner 125 associated by the liner connector with the inner wall surface 37 of shell 31. Preferably, the shock absorbing liner 125 is releaseably connected to the inner wall surface 37 of shell 31 by the liner connector. Preferably the liner connector includes a hook and loop fastener assembly, which is generally referred to as a VELCRO® attachment, as by placing portions of the hook and loop assembly on the shock absorbing liner 125 and the inner wall surface 37 of the shell 31, as is known in the art.

Figure 14:
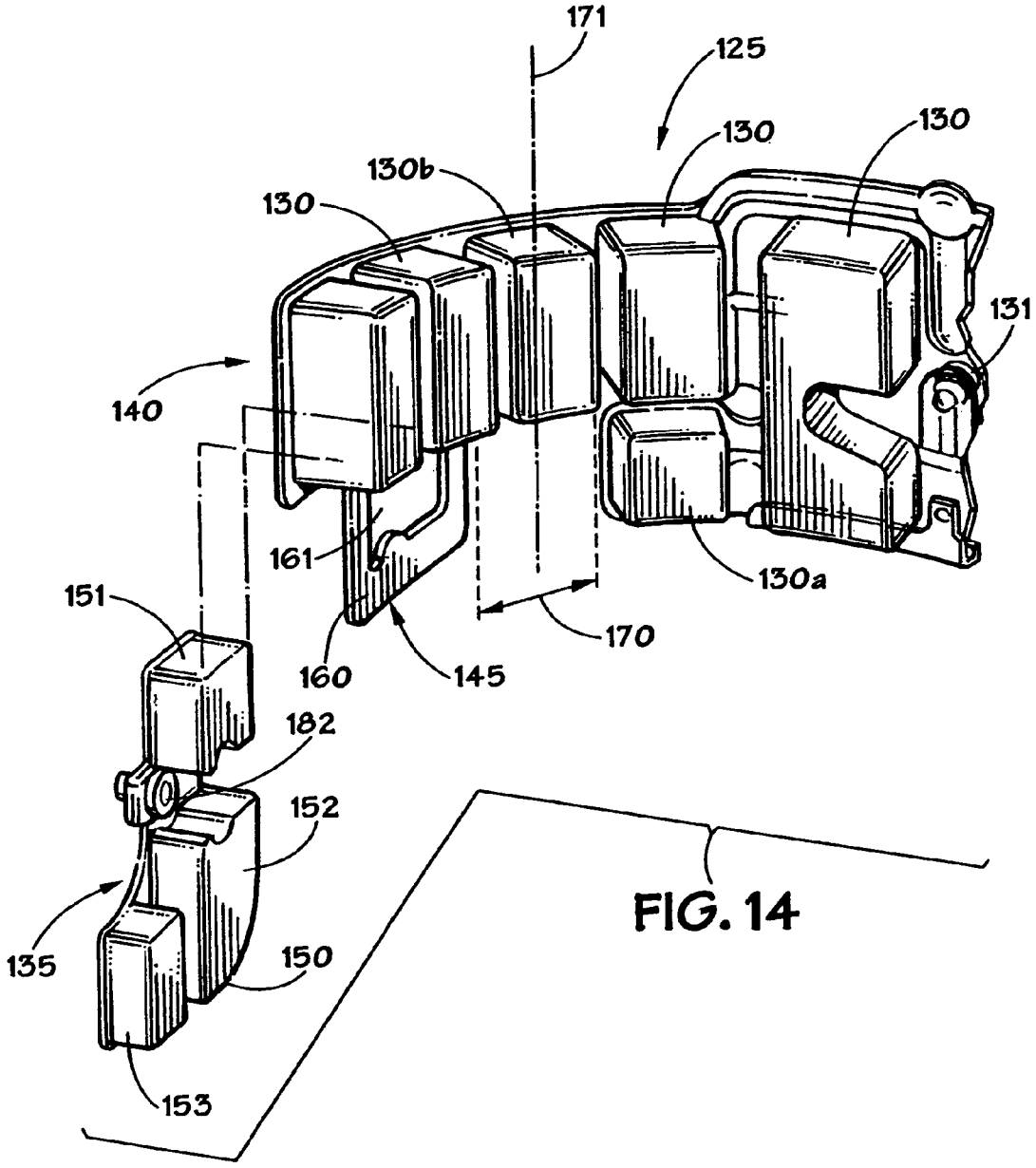
FIG. 14 is a partial perspective view of a shock absorbing liner in accordance with the present invention, corresponding to the shock absorbing liner shown in FIGS. 8 and 12.
Figure 16:
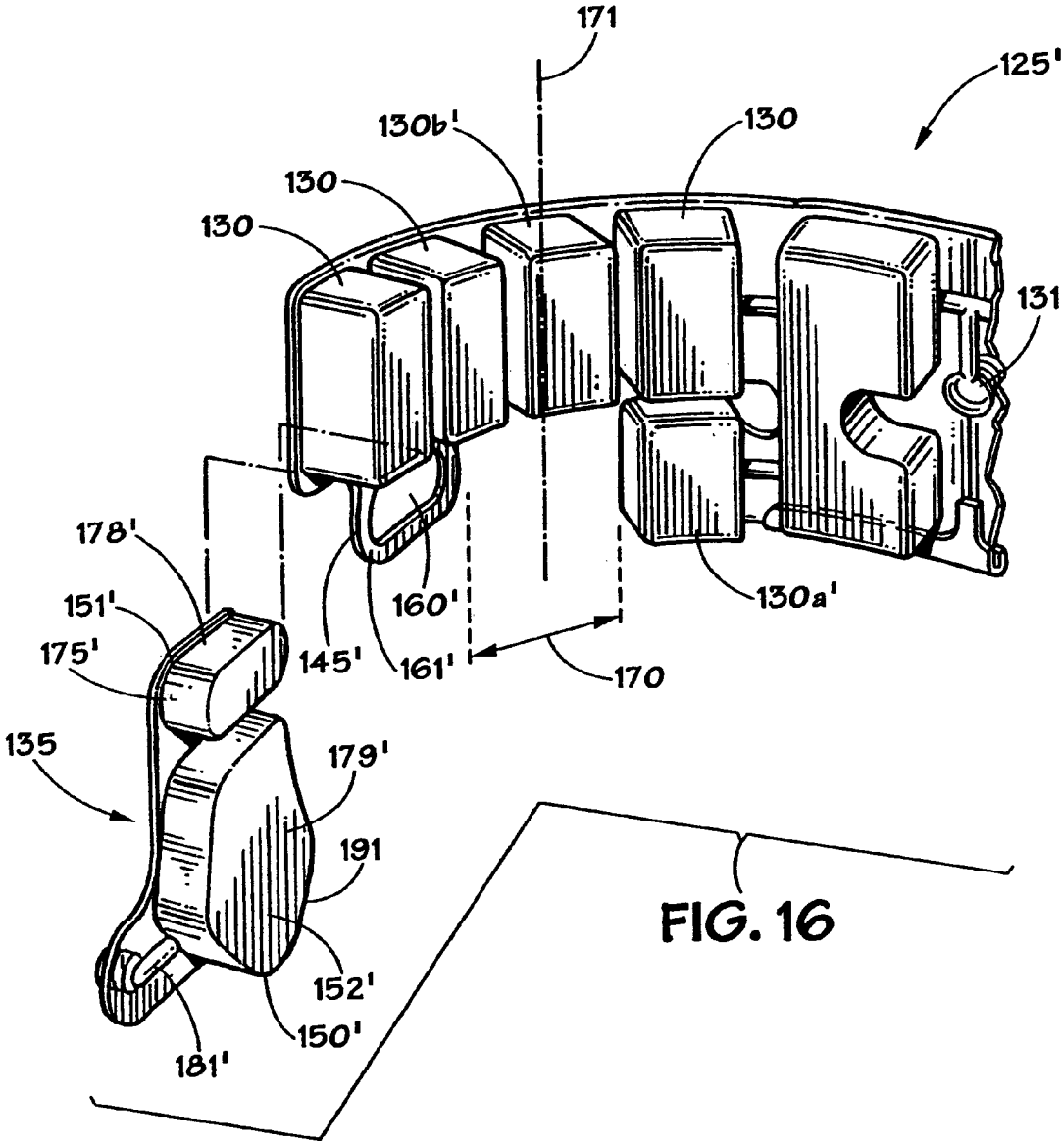
FIG. 16 is a partial perspective view of another shock absorbing liner provided with another embodiment of the resilient pad member, of the present invention, as is shown in FIG. 15.

As shown in FIGS. 14 and 16, shock absorbing liner 125 generally includes a plurality of resilient members 130 which are adapted to absorb shock forces exerted upon the shell 31, and the plurality of resilient members 130 are disposed along the inner wall surface 37 of the back 40 and sides 43, 44 of shell 31. The general construction of shock absorbing liner 125 is disclosed in U.S. Pat. No. 5,263,203, commonly assigned with the present application, and which patent is herein incorporated by reference. Shock absorbing liners 125, 125' may each include an inflation valve 131 which would mate with an opening, or port, disposed in the rear 40 of the shell 31, whereby shock absorbing liners 125, 125' could be inflated as desired. Shock absorbing liners 125, 125' each include at least one resilient pad member 135 disposed upon the inner wall surface 136 of a portion of each of the jaw flap 33 of shell 31. Two embodiments of resilient pad members 135 are illustrated. The first embodiment of resilient pad member 135 is shown in FIGS. 1, 1A, 2, 8, 12, and 14. Another embodiment of resilient pad member 135 is illustrated in FIGS. 15 and 16. Although the at least one resilient pad member, or jaw pad, 135 could be formed integral with the plurality of resilient pad members 130 of shock absorbing liners 125, 125', the resilient pad members 135 are preferably releaseably secured to the plurality of resilient members 130 forming shock absorbing liner 125. As seen in FIGS. 14 and 16 each of the shock absorbing liners 125, 125' have first and second ends 140, 141, and the shock absorbing liners 125, 125' have a connector member 145, 145' disposed at each of the ends 140, 141. Each of the connector members 145, 145' are adapted to connect to the shock absorbing liner 125, 125' at least one of the resilient pad members 135 disposed upon the inner wall surface 136 of a portion of the jaw flap 33.

As shown in FIGS. 8 and 14, one embodiment of the at least one resilient pad member 135, may be jaw pad 150. Another embodiment of the at least one resilient pad member 135 may be seen in FIGS. 15 and 16 as jaw pad 150'. Each of the resilient pad members 135, or jaw pads 150, 150' include at least one, and preferably three resilient pad members 151, 152, 153, in the case of the embodiment of jaw pad 150, and two resilient pad members 151' and 152' in the embodiment of resilient pad member 135, or jaw pad 150' of FIG. 16. As previously described, each of the resilient pad members 135, or jaw pads 150, 150', are releaseably secured to the resilient members 130 of the shock absorbing liners 125, 125' by a connector member 145, 145'. Preferably the connector member 145, 145' is a sling 160, 160', that suspends at least at least one of the resilient pad members that comprise jaw pads 150, 150'. For example, as shown in FIGS. 1A, 8 and 14, resilient pad member 151 is suspended from sling 160. Similarly, as shown in FIGS. 15 and 16, resilient pad member 151' of jaw pad 150' is suspended from sling 160. Sling 160 has an opening 161 that receives the outer configuration, or periphery, of resilient pad member 151 therein, preferably in a closely conforming or mating, snug fitting relationship. Similarly, sling 160' has an opening 161' which receives the outer periphery of resilient pad member 151' of jaw pad 150', again in preferably a mating, snug fitting relationship. It should be noted that since each of the jaw pads 150, 150' also include some hook and loop fastener material such as VELCRO®, 162, 163 (FIG. 8) and 162', 163' (FIG. 15), to releaseably secure jaw pads 150, 150' to the inner wall surface 37 of shell 31, and preferably to the inner wall surface 136 of a portion of the jaw flap 33 of the shell 31, the mating relationship between the resilient pad members 151, 151' with openings 161, 161' is not required to be a snug, frictional relationship. It may rather be a loose fitting relationship for positioning purposes only, to position the jaw pads 150, 150' in their desired location. With the hook and loop fastener material 162, 163 and 162' and 163' acting to releaseably secure the jaw pads 150, 150'.

With reference to FIGS. 12 and 14, when shock absorbing liner 125 is associated with the inner wall surface 37 of shell 31, including the at least one resilient pad member 135, or jaw pad 150 being associated with shock absorbing liner 125, an ear channel 170 is formed on each side of the shell 31 between at least one of the resilient members 130 of the shock absorbing liner 125 and at least one resilient pad member 135, or jaw pad 150. Each ear channel 170 is disposed adjacent the ear openings 112 formed in ear flaps 32. For example, with reference to FIGS. 12 and 14, ear channel 170 is formed and bounded by on one side, by resilient member 130*a*, and on the other side by resilient pad members 151 and 152. The upper end of ear channel 170, as illustrated, is bounded by resilient member 130*b*. Similarly, as seen in FIG. 16, ear channel 170 is bounded by resilient member 130*a* on one side, and by resilient pad members 151' and 152' on the other side. The top of the ear channel 170 may be bounded by resilient member 130*b'*. Each of the ear channels 170 preferably extends along an axis 171 which is disposed substantially parallel with the substantially vertical, longitudinal axis 61 of the shell 31 extending from the crown 39 of the shell 31 to the lower edge surface 42 of the shell 31 adjacent the ear flap 32. The ear channels 170 are thus substantially unobstructed from the ear opening 112 to the lower edge surface 42 of the shell 31 below the ear openings 112, whereby the wearer of the helmet may easily put on, or take off, the helmet 30 without substantial contact between the ear of the wearer and the resilient members 130 and resilient pad members 135 of the shock absorbing liners 125, 125'. It is believed that ear channels 170 will help prevent and/or minimize irritation to the player's ear.

Figure 9:
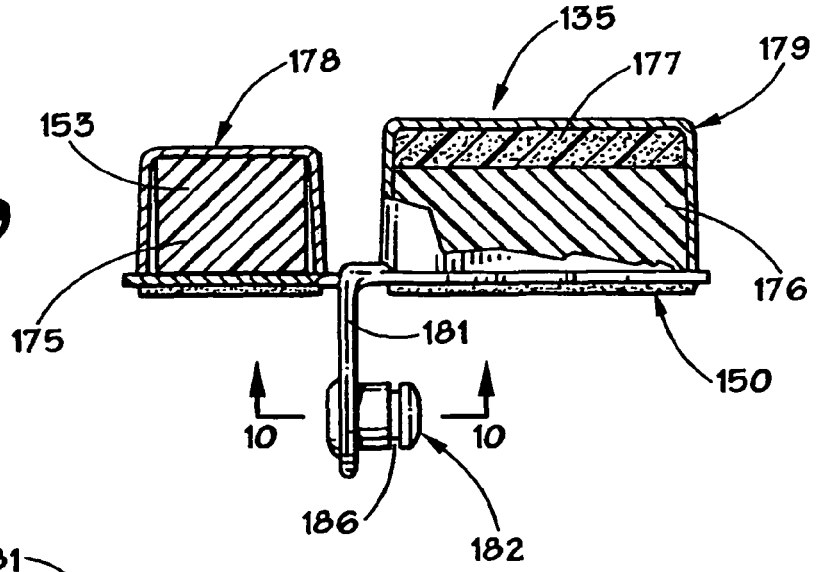
FIG. 9 is a cross-sectional view of the resilient pad member of FIG. 8, taken along line 9-9 of FIG. 8.
Figure 10:
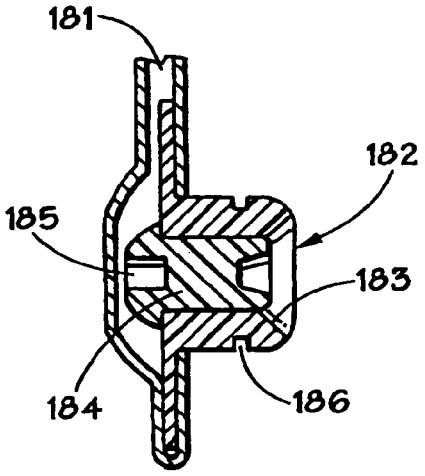
FIG. 10 is a partial cross-sectional view of the resilient pad member of FIGS. 8 and 9 taken along line 10-10 of FIG. 9.
Figure 11:
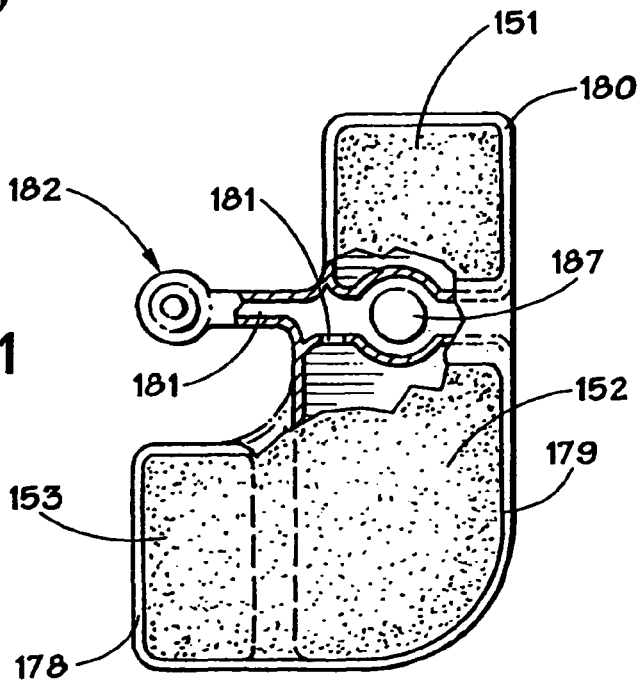
FIG. 11 is a side view of the resilient pad member of FIGS. 8-10.

With reference to FIGS. 8-11, the details of construction of jaw pad 150 are illustrated. In general, the resilient pad member 135, or pads 151, 152, 153, may include a layer of padding material 175, or two layers of padding material 176, 177 disposed in a chamber, or housing, 178, 179, 180. The chambers 178-180 may be formed of any suitable plastic material having the requisite strength and durability characteristics, as is known in the art, to function as resilient members, or pad members, for a football helmet. If desired, all of the chambers 178-180 could be filled with a single layer of padding material, or some of the chambers could be filled with a single layer, and other chambers could be filled with two or more layers of padding material. Alternatively, at least one of the resilient pad members 135, or pads 151-153 could also include a fluid such as a pressurized fluid, such as air. In the embodiment of jaw pad 150 shown in FIGS. 8-11, pads 151 and 153 are filled with a single layer of padding material, and pad 152 in addition to at least one layer 176 of padding material includes a fluid, and the fluid may be pressurized. Preferably, the fluid is air. As shown in FIG. 9, pad 152 preferably includes within its respective housing, or chamber, 179, two layers of padding material, 176, 177. A variety of different padding materials can be used for layers 175-177. For example, PVC nitrile foam, rubber foam, or polyurethane foam are examples of foam padding materials which may be utilized, as are known in the art. When multiple layers of padding material are utilized, such as in pad 152, the first layer of 176 may be one of the foregoing types of foam materials, which is generally referred to as an energy, or force attenuating, foam, and the second layer of foam padding material 177 is a "softer" foam, generally referred to as a fitting, or comfort, foam, as is known in the art. Examples of materials in construction of the foregoing described pads may also be found in U.S. Pat. No. 3,882,547, which is also commonly assigned to the present assignee of this application, which patent is incorporated herein by reference. The pressurized fluid, or air, may be provided to the interior of chamber, or housing, 179, as by an air channel 181 in fluid communication with the interior of housing 179 at one end, and in fluid communication at its other end with a suitable inflation valve 182. Inflation valve 182 may include an inlet orifice 183 which permits access to a conventional, compressible needle valve member 184 which has an exit orifice 185 in fluid communication with air channel 181. A conventional hand held pump having a conventional inflation needle may be inserted through the needle valve member 184, as is known in the art, to provide the desired amount of pressurized fluid, or air into air channel 181, to thus inflate chamber, or housing, 179, as desired. The inflation of chamber 179, in combination with the foam padding material contained therein may assist in properly sizing the helmet, including jaw pad 150, to the shape of the head of the wearer of the helmet. Air channel 181 may be formed by any conventional plastic material formed in the shape of air channel 181, such as by two layers of a suitable thermoplastic material which are heat sealed together into the configuration shown in FIGS. 9 and 11. Inflation valve 182 may include an annular seat 186 which is received within the confines of opening 187 when inflation valve 182 is folded back upon jaw pad 150 after pad 152 has been inflated, as desired, as shown in FIG. 14.

With reference to FIGS. 15 and 16, jaw pad 150' may be similar in construction to jaw pad 150. Pad 151' may also include a chamber 178' which may include a single, solid layer of foam 175', and the pad 152' may, if desired, have multiple of layers of foam disposed within chamber, or housing 179'. If it is desired to provide for a fluid within chamber 179', pad 150' may also include an inflation valve 182 as previously described, in fluid communication with an air channel 181', which in turn is in fluid communication with the interior of chamber 179'. As shown in FIG. 15, inflation valve 182 for pad 150' is associated with an inflation port 97, disposed in the outer wall surface 38 of shell 31, inflation port 97 in turn passing through the shell 31 to the inner wall surface 37 of shell 31. Thus, the inflation valve 182 of jaw pad 150' is accessible from the exterior of shell 31, whereas inflation valve 182 of pad 150 is accessible from within shell 31. Chamber, or housing, 179 for pad 152' of jaw pad 150' may have any suitable outer configuration; however, a generally polygonal configuration as illustrated in FIG. 16. The two outer wall surfaces 190, 191 of chamber 179', which define one side of ear channel 170 are of a generally rounded shape, with no sharp protrusions extending into ear channel 170. Housing, or chamber 179' of jaw pad 150' may have at least three sides, five sides being illustrated in the embodiment of FIGS. 15 and 16. It should be readily apparent to one of ordinary skill in the art that jaw pad 150' may have more than three sides, as well as could have only an outer circumference, were it to be formed in the shape of a circle.

With reference to FIGS. 12 and 13, a crown shock absorbing pad 200 is preferably disposed adjacent the inner wall surface 37 of shell 31 beneath crown 39. Preferably, crown shock absorbing pad 200 is inflatable, and includes an inflation valve 201 which is received within an opening (not shown) formed in the crown 39 of shell 31, which permits crown shock absorbing pad 200 to be inflated. Crown 200 may also include a positioning member 202, or snap member 203, or push-in-plug 204 which is received within an opening 205 in shell 31, to position and retain crown pad 200 within shell 31. Crown shock absorbing pad 200 may be of any suitable construction, and may include a single or multiple layers of a suitable shock absorbing foam material disposed therein. As seen in FIG. 12, the front 41 of shell 31 may include a conventional brow pad 210, as is known in the art.

As seen in FIGS. 8, 14-17, and 19, the helmets 30 of the present invention, including jaw pads 150, 150', when compared with previously proposed helmets, provide for a substantial amount of energy, or force attenuating, foam, or padding material, disposed in front of the coronal plane of the body of the wearer of the helmet and below the basic plane of the head of the wearer of the helmet. The energy, or force attenuating, foam, or padding material, is preferably a PVC nitrile foam or a polyurethane foam, having a density of at least approximately 5 PCF (pounds per cubic foot) and at least approximately a 25% compression deflection (ASTM D-1056 standard) of 8 PSI (pounds per square inch). As is known to those of skill in this art, the coronal plane is the frontal plane that passes through the long, or longitudinal, axis of the body, and the basic plane is a transverse plane that generally passes through the ears and the lower orbital rims of the eyes of the body.

It is to be understood that the invention is not limited to the exact details of construction, operation, exact materials or embodiment shown and described, as obvious modifications and equivalents will be apparent to one skilled in the art. Accordingly, the invention is therefore to be limited only by the scope of the appended claims.

What is claimed is:

1. A football helmet comprising:

a plastic shell configured to receive a head of a wearer of the helmet, the shell having a front region, a rear region, and two side regions wherein each side region has an ear flap with an ear opening, each ear flap having a slot and an integral jaw flap that extends forward towards the front region;

the shell further having a lower edge extending between the jaw flaps and along the rear region, the lower edge having an angled transition portion positioned below each ear opening, the transition portion formed by two segments of the lower edge that intersect, wherein the lower edge forward of the transition portion resides below the lower edge rearward of the transition portion; and a chin strap assembly that releasably secures the helmet to the wearer, the chin strap assembly having a central member and at least one flexible strap extending outwardly from each side of the central member, wherein the at least one flexible strap releasably connects to the shell.

2. The football helmet of claim 1, wherein each ear flap has a face guard connector and the slot is positioned rearward of the face guard connector.

3. The football helmet of claim 1, wherein the slot has a major axis and a minor axis, the major axis positioned vertical to the lower edge of the shell and substantially parallel to a longitudinal axis of the shell.

4. The football helmet of claim 1, wherein each ear flap has both a face guard connector and an outwardly extending first snap connector that is positioned rearward of the face guard connector, wherein the first snap connector releasably connects with an end of the flexible strap.

5. The football helmet of claim 4, wherein the slot receives a portion of the flexible strap when the flexible strap is secured to the first snap connector.

6. The football helmet of claim 4, wherein the transition portion engages the flexible strap when the flexible strap is secured to the first snap connector.

7. The football helmet of claim 4, wherein each ear flap has a second snap connector that is positioned above both the face guard connector and the ear opening in the ear flap.

8. The football helmet of claim 7, wherein a chord extending between the first and second snap connectors intersects the ear opening.

9. A football helmet comprising:

a plastic shell configured to receive a head of a wearer of the helmet, the shell having a front region, a rear region, and two side regions wherein each side region has an ear flap with an ear opening, each ear flap having an integral jaw flap that extends forward towards the front region;

the shell further having a lower edge extending between the jaw flaps and along the rear region, the lower edge having an angled transition portion positioned below each ear opening, the transition portion formed by the intersection of a forward segment of the lower edge and a rearward segment of the lower edge, and a chin strap assembly that releasably secures the helmet to the wearer, the chin strap assembly having a central member and at least one flexible strap extending outwardly from each side of the central member, wherein the at least one flexible strap releasably connects to the shell and engages the transition portion.

10. The football helmet of claim 9, wherein the intersection of the forward segment and the rearward segment define an obtuse angle of the transition portion.

11. The football helmet of claim 9, wherein the forward segment of the lower edge resides below the rearward segment of the lower edge.

12. The football helmet of claim 9, wherein the lower edge is continuous and un-interrupted between the jaw flaps, along the rear region and through the transition portions.

13. The football helmet of claim 9, wherein the angled transition portion defines a notch in the shell.

14. The football helmet of claim 9, wherein each jaw flap has a bottom edge, a substantially linear front edge that extends upward from the bottom edge and a top edge that is inclined from the front edge.

15. The football helmet of claim 14, wherein the bottom edge and the front edge of the jaw flap are substantially perpendicular.

16. The football helmet of claim 14, wherein the front edge and the top edge of the jaw flap define an obtuse angle.

17. A football helmet comprising:

a plastic shell configured to receive a head of a wearer of the helmet, the shell having a front region, a rear region, and two side regions wherein each side region has an ear flap, each ear flap having a face guard connector, an ear opening, and a slot positioned rearward of the face guard connector and below an uppermost edge of the ear opening, and a snap connector positioned rearward of the ear opening and below the uppermost edge of the ear opening; and a chin strap assembly that releasably secures the helmet to the wearer, the chin strap assembly having a central member and at least one flexible strap extending outwardly from each side of the central member, wherein the flexible strap is received by the slot.

18. The football helmet of claim 17, wherein each ear flap has a second snap connector positioned above the face guard connector, the second snap connector adapted to releasably engage a second flexible strap of the chin strap assembly.

19. The football helmet of claim 18, wherein the second snap connector is positioned above an uppermost bar of a face guard secured to the shell by the face guard connector.

20. The football helmet of claim 17, wherein the slot has a major axis and a minor axis and wherein the major axis is substantially parallel to a longitudinal axis of the shell.

21. The football helmet of claim 17, wherein each ear flap has an integral jaw flap that extends forward towards the front region, wherein each jaw flap has a bottom edge, a substantially linear front edge that extends upward from the bottom edge and a top edge that is inclined from the front edge.

22. The football helmet of claim 21, wherein the bottom edge and the front edge of the jaw flap are substantially perpendicular.

23. The football helmet of claim 21, wherein the front edge and the top edge of the jaw flap define an obtuse angle.

24. A football helmet comprising:

a plastic shell configured to receive a head of a wearer of the helmet, the shell having a front region, a rear region, and two side regions wherein each side region has an ear flap with an ear opening, and an integral jaw flap that extends forward from the ear flap;

the shell further having a lower edge extending between the jaw flaps and along the rear region, the lower edge having an angled transition portion positioned below each ear opening, the transition portion formed by two segments of the lower edge that intersect, wherein the lower edge forward of the transition portion resides below the lower edge rearward of the transition portion; and a chin strap assembly that releasably secures the helmet to the wearer, the chin strap assembly having a central member and a flexible strap extending outwardly from each side of the central member, wherein the flexible strap releasably connects to the shell.

25. The football helmet of claim 24, wherein the transition portion engages the flexible strap when the flexible strap is secured to the shell.

26. The football helmet of claim 24, wherein the ear opening has a rear edge that is rearward of the transition portion, and wherein a face guard connector is forward of the rear edge of the ear opening.

27. The football helmet of claim 24, wherein each jaw flap has a bottom edge, a substantially linear front edge that extends upward from the bottom edge and a top edge that is inclined from the front edge.

28. The football helmet of claim 24, further comprising a jaw pad removably attached to an inner surface of the jaw flap, wherein the jaw pad has a force attenuating layer with a density of at least 5 pounds per cubic foot and at least a 25% compression deflection of 8 pounds per square inch.

29. The football helmet of claim 28, wherein the jaw pad further has a comfort layer.

30. The football helmet of claim 28, wherein the jaw pad has a front edge that is positioned both in front of a coronal plane and below a basic plane of the head of a wearer of the helmet.

31. A football helmet comprising:

a plastic shell configured to receive a head of a wearer of the helmet, the shell having a front region, a rear region, and two side regions wherein each side region has an ear flap with an ear opening, and an integral jaw flap that extends forward from the ear flap;

a chin strap assembly that releasably secures the helmet to the wearer, the chin strap assembly having a central member and a pair of lower flexible strap that extend outwardly from the central member; and, the shell further having a lower edge extending between the jaw flaps and along the rear region, the lower edge having means for engaging the lower flexible strap to resist forward rolling of the helmet upon a downward impact to the helmet, wherein the means for engaging is positioned below the ear opening.

32. The football helmet of claim 31, wherein the means for engaging consists of a first angled lower edge segment intersecting a second angled lower edge segment.

33. The football helmet of claim 32, wherein the first and second angled lower edge segments form a notch configuration.

* * * * *